US006615497B1

(12) United States Patent
Saunders et al.

(10) Patent No.: US 6,615,497 B1
(45) Date of Patent: Sep. 9, 2003

(54) BENCH PLANE

(75) Inventors: Terry Ross Saunders, Ontario (CA); Lloyd Sevack, Nepean (CA); Leonard G. Lee, Almonte (CA); Matthew Siemers, Ottawa (CA); Edwin C. Tucker, Ottawa (CA)

(73) Assignee: Lee Valley Tools, Ltd., Ottowa (CA)

( * ) Notice: Subject to any disclaimer, the term of this patent is extended or adjusted under 35 U.S.C. 154(b) by 0 days.

(21) Appl. No.: 09/794,423

(22) Filed: Feb. 27, 2001

(51) Int. Cl.[7] ..... B27G 17/02

(52) U.S. Cl. ..... 30/488; 30/487; 30/489; 30/492

(58) Field of Search ..... 30/169, 487, 481, 30/484, 488, 489, 490, 491, 492

(56) References Cited

U.S. PATENT DOCUMENTS

| | | | | | |
|---|---|---|---|---|---|
| 306,877 | A | | 10/1884 | Traut | 30/487 |
| 323,804 | A | | 8/1885 | Gage | 30/487 |
| 545,732 | A | * | 9/1895 | Schade | 30/488 |
| 636,830 | A | | 11/1899 | Miller | 30/487 |
| 749,827 | A | | 1/1904 | Sjolander | 30/487 |
| 1,090,225 | A | | 3/1914 | Page | 30/489 |
| 1,221,436 | A | | 4/1917 | Gaede | 30/487 |
| 1,417,857 | A | | 5/1922 | Pfeiffer | 30/487 |
| 1,439,207 | A | * | 12/1922 | Vaughan | 30/492 |
| 1,440,649 | A | * | 1/1923 | Tvedt | 30/489 |
| 1,448,775 | A | | 3/1923 | Trump | 30/489 |
| 1,567,342 | A | | 12/1925 | Szako | 30/486 |
| 2,371,946 | A | | 3/1945 | Benn | 30/490 |
| 2,565,193 | A | * | 8/1951 | Aubin | 30/492 |
| 3,028,892 | A | * | 4/1962 | Filia | 30/487 |
| 5,694,696 | A | | 12/1997 | Lee et al. | 30/488 |

OTHER PUBLICATIONS

Rear Cover of Lee Valley & Veritas® Catalog, Copyright 1999.

Various Views of Extra Special Bench Plane, admitted to be prior art, 5 pages.

1998/1999 Issue of Lee Valley & Veritas® Catalog, Copyright 1998, p. 26, items H, J, K, and L; p. 27, items C & H.

* cited by examiner

*Primary Examiner*—Hwei-Siu Payer
(74) *Attorney, Agent, or Firm*—Josh S. Pratt; Kristin L. Johnson; Kilpatrick Stockton LLP

(57) ABSTRACT

Bench planes of different sizes having interchangeable components and an adjustable frog providing full blade support with a frog foot that extends through the plane body mouth to terminate co-planer or nearly co-planer with the sole. The rear plane handle or tote is captured between and secured soley to tines projecting from the frog that is adjustably secured to alternative sizes of plane bodies in a manner permitting forward and backward adjustment of the frog position without removing the plane blade. Superior lateral blade position control is provided by set screws in the plane body and contacting blade side edges. Adjustments in the blade cutting angle without modifying the angle at which the blade is held by the frog in the plane may be made by forming a front bevel on the front surface of the blade.

37 Claims, 8 Drawing Sheets

BENCH PLANE

FIELD OF THE INVENTION

This invention relates to woodworking planes, particularly including bench planes having cast metal bodies.

BACKGROUND OF THE INVENTION

One of the more fundamental operations in working wood is controlled removal of wood tissue in order to leave a planar surface. Planes are the most commonly used tools for accomplishing this, and enormous effort has therefore been expended in the development and refinement of planes. All planes include at least two elements: a plane body or blade holder of some sort and a blade that is fixed (often adjustably) to or in the plane body or holder so that wood tissue is cut when the blade and body assembly are moved relative to a work piece. Usually at least one surface of the plane body or holder is in contact with the workpiece. The earliest plane bodies were typically wood. In the 19th century, planes were developed with metal parts in addition to the blade but wood soles for workpiece contact, and subsequently planes were developed having cast metal bodies, including the sole.

One of the larger and more important classes of planes are known as "bench planes," and the general configurations and sizes of bench planes in western woodworking have become standard and are commonly designated with numerals including numbers 3, 4, 4½, 5, 6 and 7.

A successful bench plane must provide several specific functions and features. It must provide a mechanism for positioning a plane blade to protrude through an opening (the "mouth") in a planar registration surface, called the "sole," for contact with the workpiece. It is desirable that the distance between the position of the blade within the mouth and the leading edge of the mouth be small but adjustable, that the projection of the blade through the mouth be adjustable, and that the lateral tilt of the blade within the plane in which it is positioned be adjustable. It is desirable that the blade be held within the plane in a very secure manner and that it be supported in a way that minimizes bending or flexing of the blade in response to the forces exerted on it during use of the plane.

The manner in which a plane blade is held within the plane structure and extent to which it is supported, particularly adjacent to the blade cutting edge or arris is important to the successful function of the plane. A narrow mouth reduces tear-out during use of the plane but limits chip clearance and thereby limits the possible thickness of shavings that can be taken. Adjustability of blade position relative to the mouth can be achieved by securing the plane blade to an appropriately sloping surface of the frog (the "bed") and adjustably securing the frog to the plane body so that sliding the frog back and forth moves the plane blade back and forth within the mouth. Such adjustable-position frogs are well known in the art. However, conventional adjustable-frog plane designs generally suffer from at least three problems. First, the frog position frequently is not adjustable without removing the plane blade, which tends to dissuade users from adjusting frog position, and the frog often is not secured to the plane body with sufficient rigidity. Second, once the blade is removed to gain access to the frog securing screws, when the screws are loosened not only can the frog move fore and aft, but is also free to move laterally and to pivot slightly because the screws pass through slotted holes in the frog. While this is advantageous in that tight dimensional tolerances are not required on account of the adjustability available, it also makes proper adjustment or resetting the frog a time consuming and difficult effort. Third, and most important, because the frog (and therefore the bed) lies entirely above the portion of the plane body on which it rests, but the blade must project down below the surface or sole of the plane body, a portion of the blade projecting below the frog is unsupported.

Another limitation associated with conventional bench planes is the fixed bed angle. Bench plane blades are used with the arris-forming bevel down, so the bed angle of the frog, i.e., the angle between the frog surface against which the plane blades lies and the sole of the plane, determines the cutting angle of the blade. The bed angle of bench plane frogs is fixed, and therefore cannot be changed to alter the plane blade cutting angle, but different cutting angles can be desirable under differing planing circumstances.

Different woodworking operations require the use of different sizes of planes, so it is not possible to produce a single bench plane that functions optimally in all situations. However, the principal difference among bench planes is the length of the sole, and it is therefore possible to manufacture a line of bench planes using a substantial number of parts that are interchangeable among plane sizes. Such interchangeability provides two potential benefits. The first is reduction in manufacturing complexity resulting from reduction in the number of parts that need be manufactured for an entire bench plane line. Second is the possibility of reusing certain of the same parts with different plane soles in order to provide bench planes of different sizes. The practical utility of using parts with different soles, however, is determined to some extent by the ease with which such parts can be moved from one sole to another.

Despite the long history of bench plane development, these considerations leave room for further improvement of such planes.

SUMMARY OF THE INVENTION

This invention improves prior bench plane designs and makes practical interchangeability of components among plane bodies of different sizes, which facilitates manufacture of a wide range of plane sizes differing in both width and length utilizing an economically small number of components. In the bench planes of this invention, the rear plane handle or tote is captured between and secured soley to projecting tines attached to a frog that is adjustably secured to a plane body in a manner permitting forward and backward adjustment of the frog position without removing the plane blade. Plane blade lateral and depth adjustment is accomplished utilizing a mechanism also secured entirely to the frog, thereby providing a frog, blade and handle assembly usable interchangeably on plane bodies of differing lengths. The design of the frog and lever cap permit utilization of the same frog and lever cap castings for bench planes and blades of differing widths, because the component widths can be easily reduced by machining and/or grinding relatively small amounts of materials off of each side of the components.

Of critical importance, the frog of the invention extends through the plane body to provide a "foot" having a bottom surface co-planar with the sole that contacts the workpiece together with the sole. This extension provides contact with the underside of the plane blade all the way down to the blade bevel, thus providing the maximum such blade contact possible. This provides support nearer the blade cutting edge or arris than conventional metal component plane frogs provide and thereby reduces blade chatter.

Superior lateral blade position control is provided by set screws having flat ends penetrating the two sides of the plane body immediately above the mouth. These set screws prevent lateral movement of the plane blade adjacent to the arris, thus improving function of the lateral adjustment mechanism and reducing the likelihood of lateral blade position shifts during use of the plane.

The frog/blade/handle assembly of this invention is usable with multiple lengths of plane bodies and can be easily modified for use with multiple widths of plane bodies. Set screws or other structures in one of the frog or plane body for contact wit the other of the plane body and frog permit adjustment accommodating differences in plane body thicknesses.

Adjustments in the blade cutting angle without modifying the angle at which the blade is held by the frog in the plane may be made by forming a front bevel on the front surface of the blade ("front" meaning the side of the blade facing forward and up when it is in the plane).

DETAILED DESCRIPTION OF THE DRAWINGS

Figure 1:
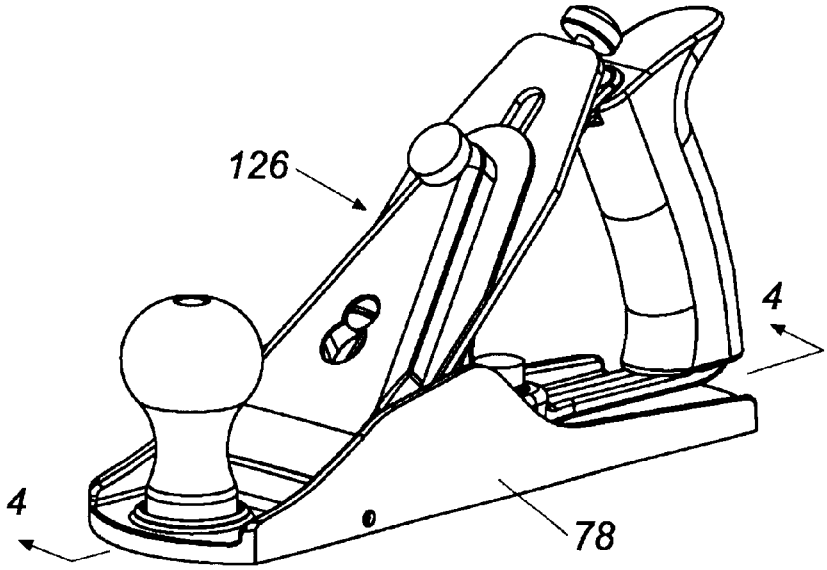
FIG. 1 is a perspective view of a number 4½ embodiment of the bench plane of this invention showing the front and left side.
Figure 2:
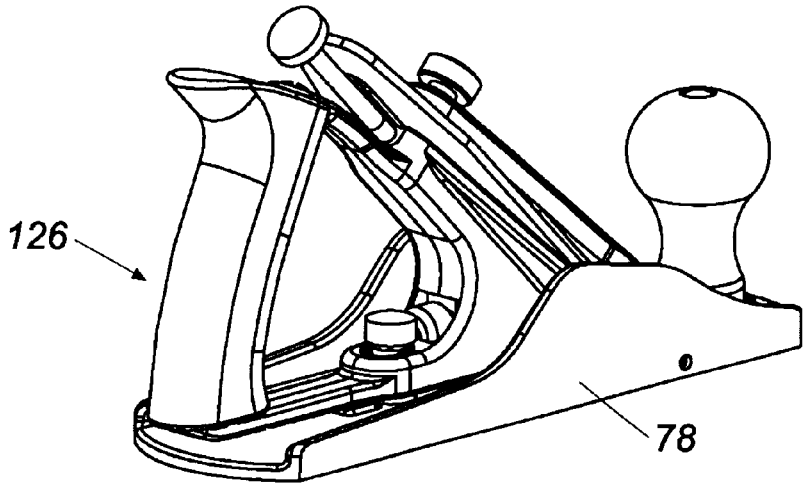
FIG. 2 is a perspective view of the number 4½ embodiment of the bench plane of this invention shown in FIG. 1 but showing the rear and right side.
Figure 3:
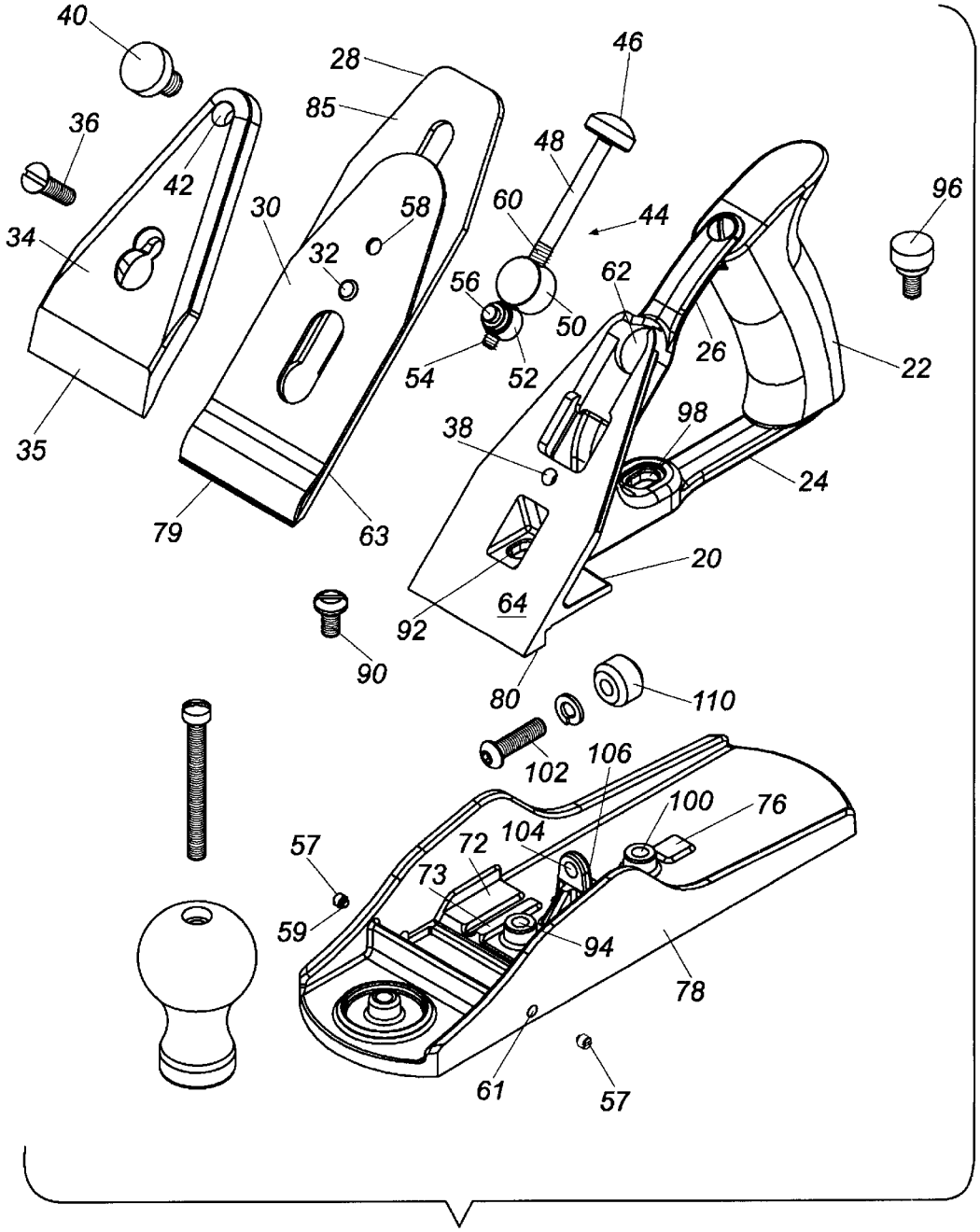
FIG. 3 is an exploded perspective view of the number 4½ bench plane embodiment of this invention shown in FIGS. 1 and 2.

As will be readily appreciated by reference to FIGS. 1, 2 and 3, a number 4½ embodiment of the bench plane of this invention is assembled using a frog 20 to which a rear handle 22 is attached between projecting arms 24 and 26 of the frog 20. A blade 28 is secured to a chip breaker 30 with a blade screw 32, and the chip breaker 30 and blade 28 are secured to the frog by a lever cap 34 using a lever cap screw 36 that passes through the lever cap 34 and into a threaded lever cap hole 38 in frog 20. A lever thumbscrew 40 passes through a threaded hole 42 in the lever cap 34 and bears against the chip breaker 30 to force the opposite end 35 of lever cap 34 against chip breaker 30.

Blade 28 needs to be adjustable to slide up and down sloping bed surface 64 of frog 20 to adjust the projection of arris 79 below sole 84 to control the thickness of shavings. Blade 28 also needs to be adjustable laterally so that the tilt of arris 79 relative to sole 84 is controlled so that shavings of uniform thickness (or of longitudinally symmetrical thicknesses) can be produced. Put differently, lateral blade adjustments permit a straight arris 79 to be positioned parallel to sole 84.

Both projection and lateral position of blade 28 relative to frog 20 are controlled by an adjustment assembly 44 comprising a blade adjustment knob 46 attached to a blade adjustment shaft 48 that passes through a blade adjustment pivot 50 and a follower 52.

Follower 52 is threaded onto a smaller diameter threaded portion 54 of shaft 48 and has a round projecting knob or protrusion 56 that is received in a round hole 58 in a chip breaker 30. Pivot 50 is threaded onto a larger diameter threaded portion 60 of shaft 48. The threads on portions 54 and 60 of shaft 48 are opposite in direction so that rotation of shaft 48 within pivot 50 and follower 52 causes pivot 50 and follower 52 to move toward each other with rotation in one direction and away from each another with rotation in the other direction. Pivot 50 is received in recess 62 in frog 20, which allows pivot 50 to rotate as knob 46 is moved laterally and forces followers 52 to move up and down when knob 46 is rotated, thereby causing blade 28 and chip breaker 30 to pivot or move laterally when knob 46 is pivoted and to slide up and down the face 64 of frog 20 when knob 46 is rotated.

Figure 17:
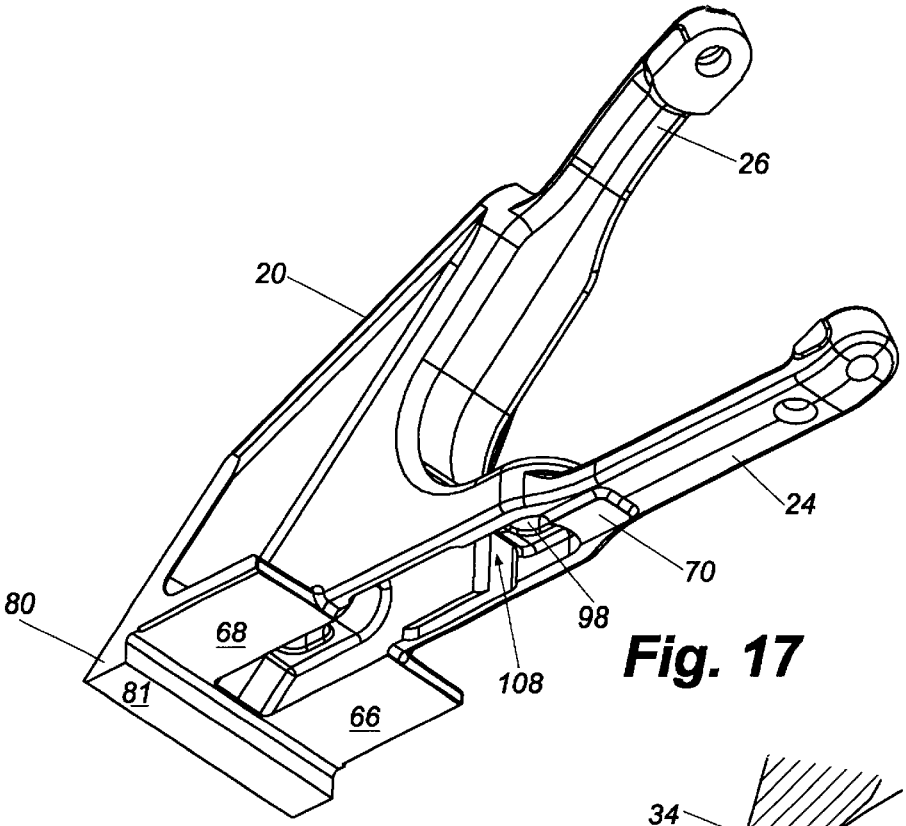
FIG. 17 is a worm's eye perspective view of the bottom and left side of the frog of this invention.

As may be seen in FIG. 17, the underside of frog 20 has three registration surfaces 66, 68 and 70 generally produced by machining the casting for frog 20 so that such surfaces are co-planar. The registration surfaces 66, 68 and 70 rest against corresponding surfaces 72, 73 and 76 on plane body 78 (visible in FIG. 3). Surfaces 72 and 73 on plane body 78 could be formed as a single larger surface. However, formation of two smaller protrusions machined to produce surfaces 72 and 73 reduces the risk of shrinkage in the areas of the casting for plane body 78 where these surfaces are located. Additionally, debris can fall between the pair of surfaces 72 and 73 rather than remaining between registration surfaces on the plane body 78 and frog 20.

Set screws 57 with flat ends 59 are positioned in threaded holes 61 on each side of plane body 78. These set screws bear against the opposite sides 63 of blade 28 near the blade arris 79. By contacting the blade sides 63, set screws 57 prevent lateral movement of the arris 79 end of blade 28. This fores blade 28 to pivot rather than simply to slide sideways when adjustment knob 46 is pushed laterally, thereby improving "lateral adjustability" of blade 28, which might more accurately be termed "tilt" of cutting arris 79 relative to frog 20. Set screws 57 also reduce the likelihood that a knot or other irregularity in a workpiece will displace blade 28 laterally.

Figure 4:
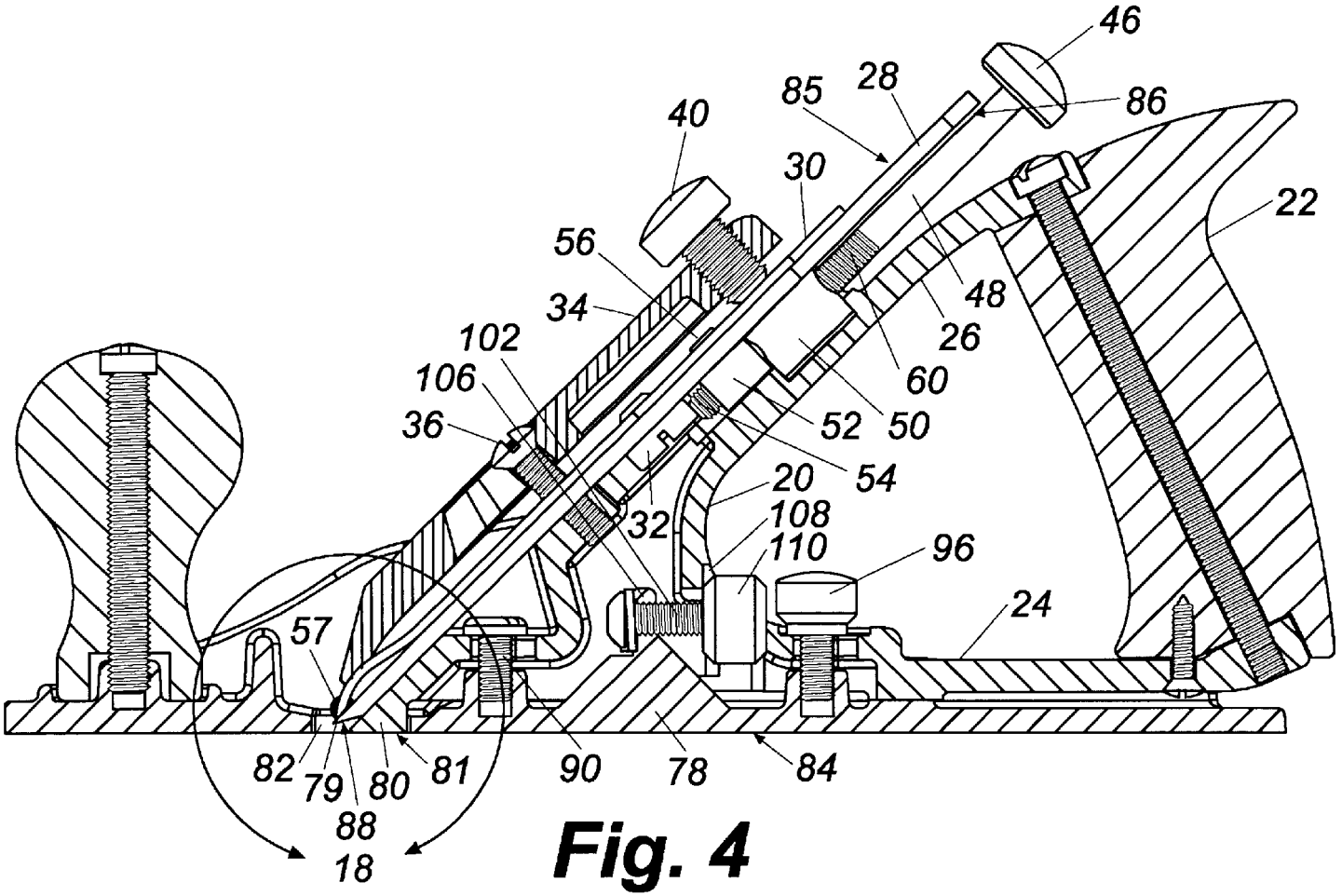
FIG. 4 is a side elevation view in section through the handles, lever cap, frog and plane body taken along line 4—4 in FIG. 1, with other components not in section.
Figure 5:
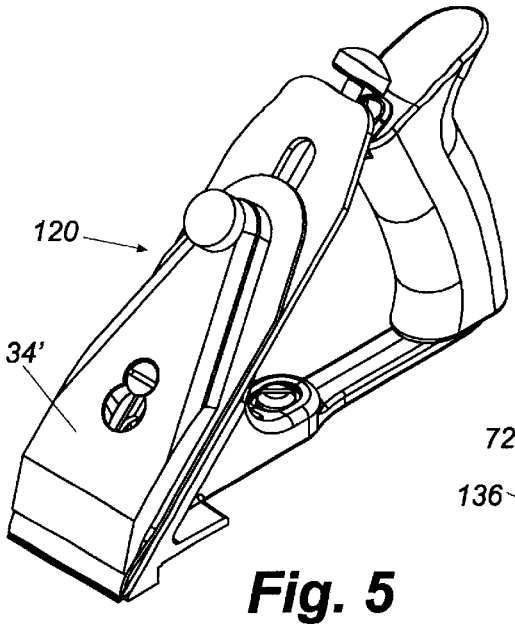
FIG. 5 is a perspective view of an assembled bench plane frog, handle and blade assembly of this invention with the frog, blade and lever cap sides ground to produce a smaller width assembly than illustrated in FIGS. 1, 2 and 3.
Figure 18:
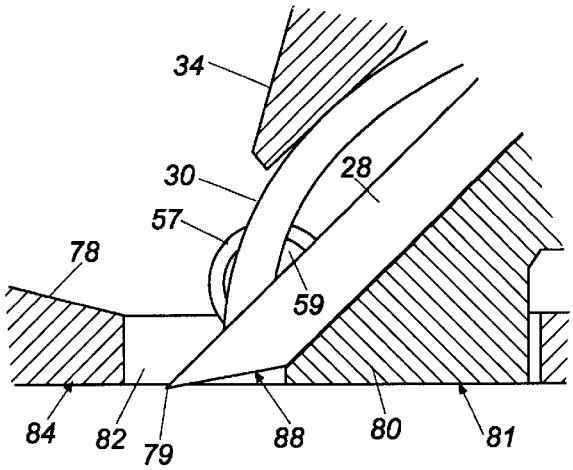
FIG. 18 is an enlarged version of the portion of FIG. 4 within circle 18.

As is easily seen in FIGS. 3, 4 and 5, plane body 78 is penetrated by a long mouth 82 that receives not only the blade 28 cutting arris 79 but also a foot 80 that projects from frog 20 into mouth 82. Foot 80 terminates co-planar with a sole 84 of plane body 78. As may ben seen in FIGS. 4 and 18, this permits frog 20 to support the back side 86 of blade 28 all the way down blade 28 to the beginning of bevel 88 that forms arris (using "back" to refer to the face or side 86 of the blade 28 lying against the frog 20 and facing back and down when the blade is in the plane). This support reduces flexing of blade 28 during use and thereby reduces blade chatter.

Frog 20 is secured to plane body 78 with two screws. First, a frog screw 90 passes through oblong hole 92 in the frog 20 and into forward threaded hole 94 in body 78. As can be appreciated by reference to FIGS. 4, 10, 12, 14 and 16, screw 90 is accessible with the lever cap 34, chip breaker 30 and blade 28 in place. Second, a thumb screw 96 passes through oblong hole 98 in frog 20 and into threaded rear hole 100 in body 78. A frog adjustment screw 102 is secured to body 78 by threaded engagement in hole 104 in pedestal 106 protruding from body 78. Thumb nut 110 is threaded into screw 102 and captured in slot 108 within frog 20 (see FIGS. 4 and 17). With screw 90 just snug, thumb screw 96 can be loosened, and frog 20 can then be moved forward and back on body 78 to vary the amount of mouth 82 forward of blade 28. This can be done without removing the blade 28 from frog 20, making adjustment easier to accomplish and easier to accomplish accurately because the effect of such adjustments are visible as they are done, not only after the blade is replaced on the frog as in the case with some prior bench planes.

As noted above, the bottom 81 of frog foot 80 should be flat and co-planar with sole 84. This can be achieved by first matching the registration surfaces 66, 68, and 70 on frog 20, and 72, 73, and 76 on body 78. Frog 20 is then attached to body 78, and the sole 84 and bottom 81 of frog foot 80 are machined simultaneously. Such "custom machining" of a frog foot 80 to match a particular body 78, somewhat limits interchangeability of bodies and frogs, but, subject to this consideration, the frog/handle/blade assemblies of this invention can be used with bodies of appropriate width and differing lengths.

Furthermore, it is possible to anticipate and deal with small variations in the distance between the planes within which frog foot surface 81 and frog registration surfaces 66, 68 and 70 lie. For instance, chisel plane body 122 (shown in FIGS. 6 and 7) can be manufactured with slightly less distance between the sole 84' of chisel plane body 122 and registration surfaces 72', 74', 76' than between the registration surfaces 72, 73 and 76 of the sole 84. Each of chisel plane body 122 registration surfaces 72' and 74' may then be penetrated by a set screw 136 which can be adjusted to protrude from registration in surfaces 72' and 74' just enough to bring the frog foot surface 81 into the same plane as the bottom 84' of chisel plane body 122.

The set screws 136 could alternatively be positioned in the frog, protruding, for instance, from frog registration surfaces 66 and 68 (visible in FIG. 17) for contact with registration surfaces 72 and surface not visible on bench plane body 78, or surfaces 72' and 74' on chisel plane body 122. Since chisel planes have no mouth, chisel plane body 122 and chisel plane frog/handle/blade assembly 120 do not need to be capable of sliding relative to each other, so there need be no pedestal 106 or screw 102 in chisel plane body 122.

Figure 6:
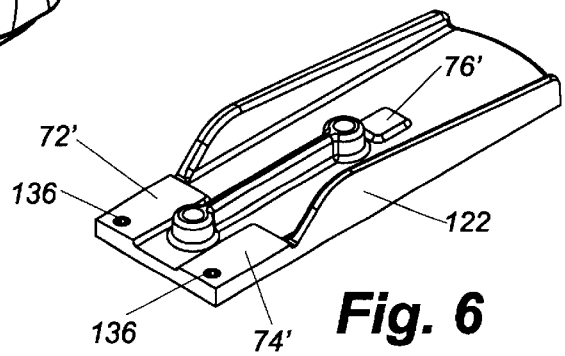
FIG. 6 is a perspective view of a chisel plane sole useable with the blade handle and frog assembly shown in FIG. 5 to produce a chisel plane.
Figure 7:
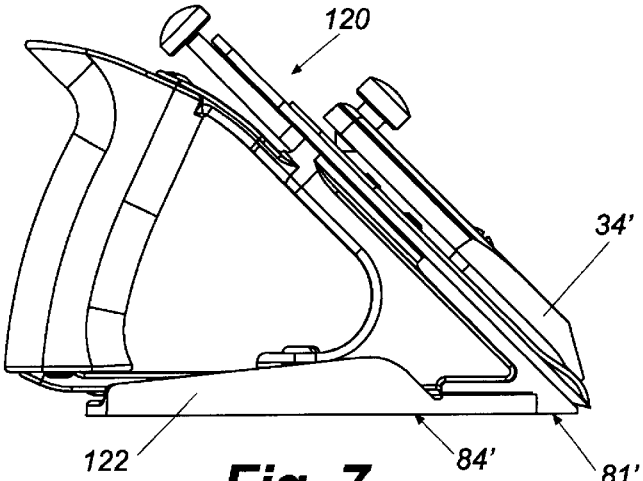
FIGS. 7 and 8 are side elevation and top plan views, respectively, of the chisel plane of the present invention, the components of which are illustrated in FIGS. 5 and 6.
Figure 8:
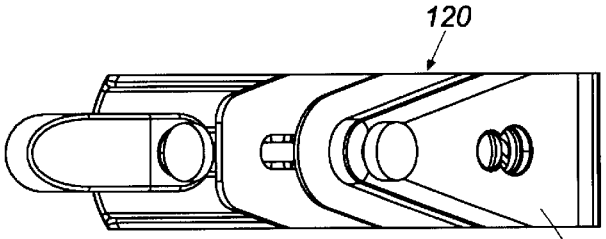
Figure 9:
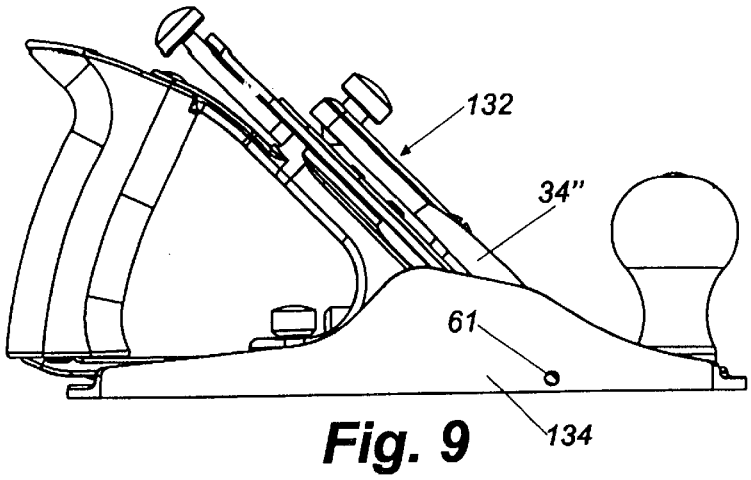
FIGS. 9 and 10 are side elevation and top plan views, respectively, of a number 3 embodiment of the bench plane of this invention.
Figure 10:
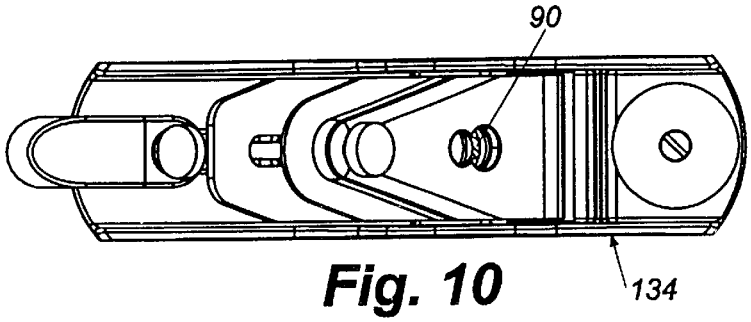
Figure 11:
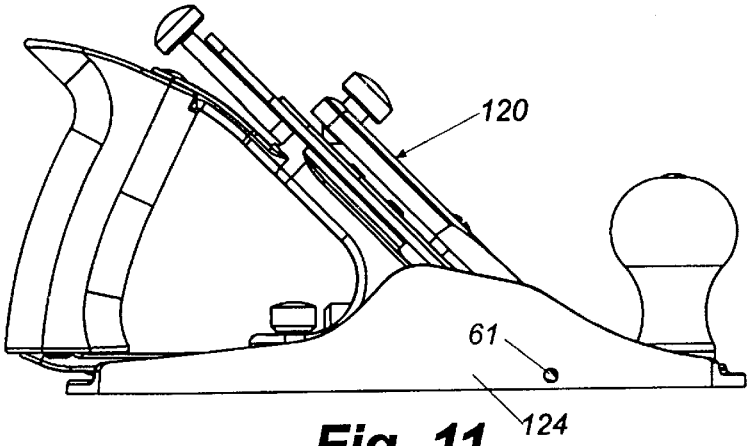
FIGS. 11 and 12 are side elevation and top plan views, respectively, of a number 4 embodiment of the bench plane of this invention.
Figure 12:
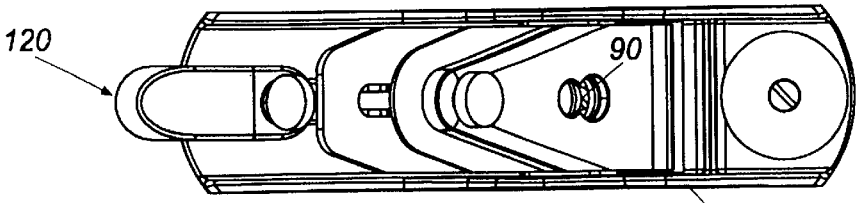
Figure 13:
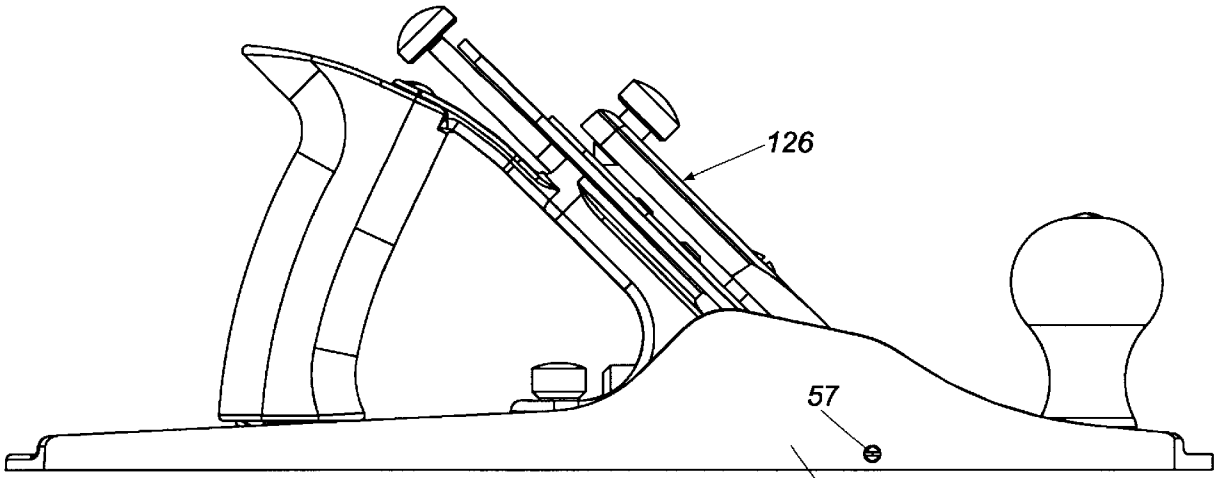
FIGS. 13 and 14 are side elevation and top plan views, respectively, of a number 5 embodiment of the bench plane of this invention.
Figure 14:
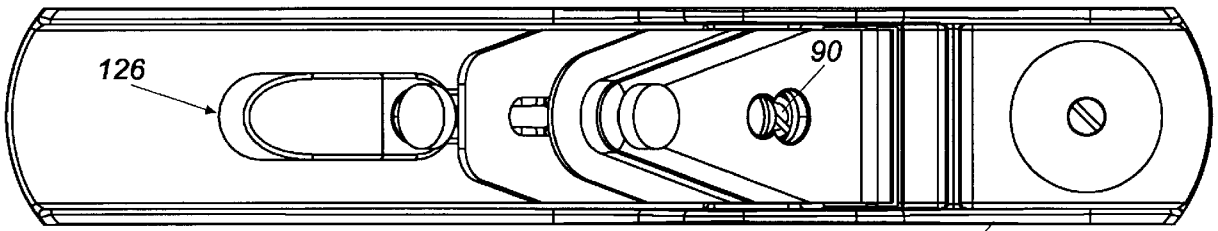
Figure 15:
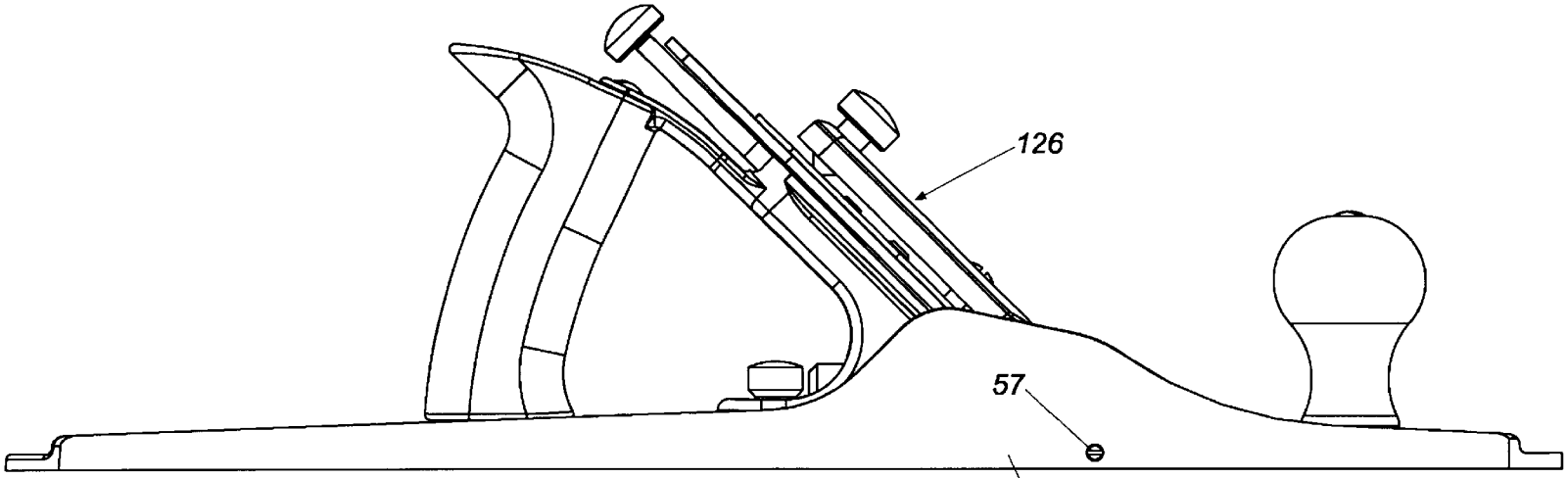
FIGS. 15 and 16 are side elevation and top plan views, respectively, of a number 6 embodiment of the bench plane of this invention.
Figure 16:
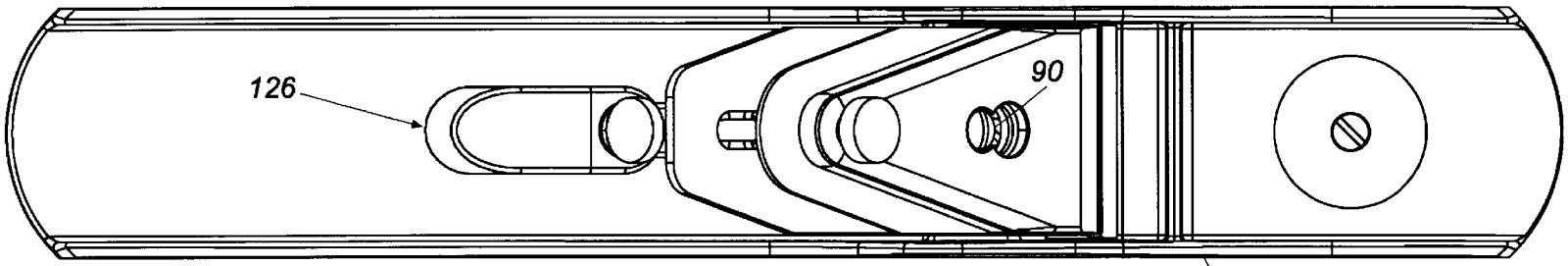

The medium width frog/handle/blade assembly 120 of FIG. 5 can be used on the chisel plane body 122 of FIG. 6 to produce the chisel plane shown in FIGS. 7 and 8, or on the No. 4 plane body 124 of FIGS. 4, 11 and 12 or on the No. 5 plane body 128 in FIGS. 13 and 14 using the same frog casting as used for frog 34, but ground narrower to produce a frog 34'. Similarly, the wider frog/handle/blade assembly 126 show in No. 4½ plane body 78 in FIGS. 1, 2, 3 and 4 and using frog 34 could also be used on No. 6 plane body 130 in FIGS. 15 and 16. Finally, a narrow frog/handle/blade assembly 132, again using the same frog casting, machined or ground narrower to produce the frog 34", can be used on No. 3 plane body 134.

Figure 19:
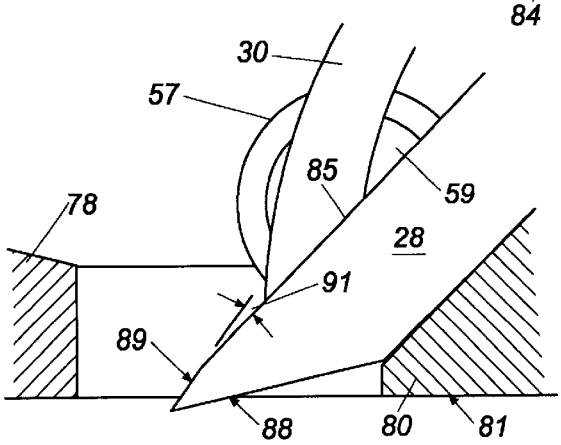
FIG. 19 is an enlarged view similar to FIG. 18 with a blade front bevel in accordance with this invention.

As is illustrated in all of the figures except for FIG. 19, and as is conventional in bench planes, cutting arris 79 is formed by intersection of the blade front side 85 and bevel 88, and bevel 88 is oriented down when blade 28 is secured to frog 20. With a cutting arris so formed and the bevel down, the pitch of the frog (i.e., the angle between the sole 84 and frog surface or bed 64) determines the cutting angle. Stated slightly differently, the cutting angle is the angle between the sole 84 and the top or leading surface on the blade that forms the cutting arris 79. The standard frog pitch for bench planes is 45°, and that is the pitch illustrated in the embodiments of this invention illustrated in the figures. Other frog pitches could be utilized, however, in practicing this invention in order to achieve other cutting angles. For instance, the frog 20 could be produced with a frog bed or surface 64 positioned at an angle of 50° or 55° or another angle. Benefits of higher cutting angles include reduced risk of grain tear out, particularly when the wood must be planed against the grain and with highly figured woods, but this comes with an expense—the need for increased horizontal planing force.

However, as illustrated in FIG. 19, essentially the same result as a larger frog bed angle can be achieved while continuing to use a frog 20 with a 45° pitch by adding a small front bevel 89 to the blade 28 forming angle 91 relative to blade front 85. An added benefit of doing so in lieu of raising the frog bed angle, is that overall included angle between the bevel 88 and the front bevel 89 is greater than the original included angle between the bevel 88 and the front 85 of the blade 28, providing increased cutting arris toughness and longevity. For instance, a 10° front bevel 89 on blade 28, together with a 45° frog bed angle will result in a cutting angle of 55° (45° bed+10° front bevel). An even larger front bevel can change a plane with a 45° bed angle into one that functions as a scraping plane, producing a type II or III chip (for explanation of chip types, see pages 229 to 232 of Lee, Leonard G., *The Complete Guide to Sharpening* (1995, Tauton Press) which is incorporated herein by reference). In this manner, a variety of cutting angles may be achieved using the same plane without changing frogs or adjusting frog bed angle.

As will be understood by those skilled in the art, numerous modifications and variations in this invention can be made without departing from the spirit of the invention as described above by reference to illustrative embodiments, or from the scope of the following claims. For instance, the plane body and frog can be cast of ductile iron, gray iron or bronze, as well as composite materials such as fiber reinforced polymeric materials. Such components can also be machined or fabricated utilizing other techniques than casting or molding. The blade can be made of A-2 steel or other alloys. Knobs may be brass, steel or other materials, including appropriate plastics. The knob and handle can be made from traditional materials such as rosewood, beech or ample, or they could be made from appropriate plastics or metals.

Similarly, while the blade adjustment mechanism 44 described above is an excellent design, other blade adjustment mechanisms could also be used, including ones that utilize separate components for adjustment of blade projection and lateral position. Substitutions of other structures are also possible for the set screws 57 in the side of the plane bodies or the set screws 136 in the surfaces 72' and 74' of chisel plane body 122. Another structure such as a wedge could be used instead of one or both set screws 136 for limiting lateral movement of the cutting arris 79 end of the blade 28. Furthermore, a single set screw 136 or other structure for contacting only one edge 63 of blade 28 could be used. Set screws or substitute structures could even be omitted, thereby foregoing the advantages conferred by such devices, while retaining other features of this invention.

Different configurations of registration surfaces 66, 68 and 70 on frog 20 and registration surfaces 72, 74 and 76 on plane body 78 could also be used. Different configurations of threaded or other fasteners and adjustment devices could be used for securing frog 20 to plane body 78 rather than thumb screw 96, screw 90 and screw 102 and thumb nut 110, provided that such alternative fastener and adjustment structures hold frog 20 and plane body 78 firmly together during use of the plane.

Finally, among many other variations possible in the practice of this invention, this invention can be used in bench planes of sizes other than those mentioned above and in numerous other hand planes such as more specialized planes like panel raising and planes among many others.

What is claimed is:

1. A bench plane, comprising:

a plane body having a sole penetrated by a mouth, a frog adjustably attached to the body for location in different positions and having a foot extending through the mouth and having a surface co-planar with the sole in all positions.

2. The plane of claim 1, further comprising a handle attached to the frog.

3. The plane of claim 2, wherein the handle is secured to the frog between tines that project from the frog for attachment to opposite ends of the handle.

4. The plane of claim 1, further comprising a blade and blade adjustment mechanism positioned between the blade and the frog.

5. The plane of claim 1, further comprising a blade adjustably attached to the frog and two set screws in the body for contacting the blade.

6. The plane of claim 1, further comprising a fastener adjustably attaching the frog to the body, which fastener is accessible when a blade and a chip breaker are secured to the frog with a lever cap.

7. The plane of claim 1, wherein the frog is adjustably attached to the body with two fasteners, both of which are accessible when a blade and a chip breaker are secured to the frog with a lever cap.

8. The plane of claim 1, further comprising a blade and a chip breaker secured to the frog by a lever cap, and two screws longitudinally centered on the plane securing the frog to the body, one of which screws is accessible through openings in the lever cap, the chip breaker and the blade.

9. The plane of claim 8, further comprising a rotatable component for adjusting the longitudinal position of the frog on the body.

10. The plane of claim 9, wherein the other of the screws is a thumbscrew.

11. The plane of claim 1, further comprising at least one screw threaded into the plane body for contact with the frog to adjust the position of the frog foot relative to the sole.

12. The plane of claim 1, further comprising two screws positioned in one of the plane body or the frog for contact with the other of the frog or the plane body to adjust the position of the frog foot relative to the sole.

13. The plane of claim 1, further comprising two set screws threaded into the plane body for contact with the frog to adjust the position of the frog foot relative to the sole.

14. The plane of claim 1, further comprising a plane blade having a cutting arris formed by the intersection on the blade of a back bevel and a front bevel.

15. A bench plane, comprising:

(a) a plane body having a sole penetrated by a mouth, (b) a frog adjustably attached to the body and having:

(i) a foot extending through the mouth and having a surface co-planar with the sole, and (ii) tines that project from the frog, (c) a handle secured to the frog between tines that project from the frog, (d) a blade positioned against the frog, the blade having:

(i) a cutting arris formed by intersection between a back bevel and another surface, and (ii) an opposed pair of side edges, (e) a blade adjustment mechanism positioned between a portion of the blade and the frog, (f) two set screws in the body, one of which set screws contacts each of the pair of blade opposed side edges, (g) a chip breaker secured to the blade, (h) a lever cap securing the blade and the chip breaker to the frog, (i) two screws longitudinally centered on the plane body for adjustably securing the frog to the plane body, both of which are accessible when the blade and the chip breaker are secured to the frog, and (j) a thumbnut captured within the frog and threaded onto a screw shaft attached to the body for adjusting the longitudinal position of the frog on the body.

16. The plane of claim 15, wherein the another surface forming the blade cutting arris is a front bevel.

17. A bench plane, comprising:

a plane body having a sole and a mouth in the sole, a plane body having a front surface, a back surface, two sides, and a bevel intersecting (a) the front surface or another surface of the blade to form a cutting arris, and (b) the back surface, and a frog attached to the plane body and to which the blade is adjustably attached, the frog having a frog foot projecting into the mouth and having a sloping surface along which the blade slides during adjustment and that is in contact with the blade at least immediately adjacent to the intersection of the blade back surface and the bevel.

18. The plane of claim 17, further comprising at least one set screw adjustably positioned in the plane body for contact with one of the two plane blade sides.

19. The plane of claim 17, wherein the plane body comprises a chisel plane body.

20. The plane of claim 19, further comprising at least one screw threaded into the plane body for contact with the frog to adjust the position of the frog foot relative to the sole.

21. The plane of claim 19, further comprising two screws positioned in one of the plane body or the frog for contact with the other of the frog or the plane body to adjust the position of the frog foot relative to the sole.

22. The plane of claim 17, further comprising a handle attached to the frog.

23. The plane of claim 22, wherein the handle is secured to the frog between tines that project from the frog for attachment to opposite ends of the handle.

24. The plane of claim 17, further comprising a blade adjustment mechanism positioned between the plane blade and the frog.

25. The plane of claim 17, further comprising a fastener adjustably attaching the frog to the body, which fastener is accessible when a chip breaker is attached to the blade and the blade and the chip breaker are secured to the frog with a lever cap.

26. The plane of claim 17, wherein the frog is adjustably attached to the body with two fasteners, both of which are accessible when a chip breaker is attached to the blade and the blade and chip breaker are secured to the frog with a lever cap.

27. A bench plane, comprising:

a plane body having a sole, a plane blade having a front surface, a back surface, two sides, and a bevel intersecting (a) the front surface or another surface of the blade to form a cutting arris, and (b) the back surface, a frog attached to the plane body and to which the blade is adjustably attached, the frog having a frog foot having a sloping surface along which the blade slides during adjustment and that is in contact with the blade at least immediately adjacent to the intersection of the blade back surface and the bevel, a chip breaker secured to the blade, a lever cap securing the blade and the chip breaker to the frog, and two screws longitudinally centered on the plane body securing the frog to the body, one of which screws is accessible through openings in the lever cap, the chip breaker and the blade.

28. The plane of claim 27, further comprising a rotatable component for adjusting the longitudinal position of the frog on the body.

29. The plane of claim 28, wherein one of the two screws is a thumbscrew.

30. The plane of claim 17, wherein the bevel forms the cutting arris by intersecting the another surface and the another surface comprises a front bevel.

31. A kit for providing (1) a bench plane having plane sole both in front and in back of a plane blade cutting arris and (2) a chisel plane having plane sole only in back of the plane blade cutting arris, the kit comprising:

a handle attached to a frog having planar structure for contact with a plane body structure, a blade attached to the frog, the blade having a front surface, a back surface, and a bevel intersecting (a) the front surface or another surface of the blade to form a cutting arris, and (b) the back surface, a bench plane body attachable to the frog and having a bench plane body planar structure for contact with the frog planar structure and having a sole structure to provide plane sole both in front and in back of the blade, and a chisel plane body attachable to the frog and having a chisel plane body planar structure for contact with the frog planar structure and having a sole structure to provide plane sole only in back of the blade, the frog having a foot that:

(a) projects below the plane of the planar structure of the respective one of the bench plane body or the chisel plane body when the frog is attached to one of the plane bodies, and (b) has a sloping surface along which the blade slides during adjustment and that is in contact with the blade at least immediately adjacent to the intersection of the blade back surface and the bevel.

32. The kit of claim 31, further comprising at least one screw in one of (a) the bench plane body or the chisel plane body or (b) the frog for contact with the other of (a) the frog or (b) the bench plane body or the chisel plane body to adjust the position of a frog foot relative to the bench plane or the chisel plane body to which it is attached.

33. A kit for providing (1) a bench plane having a first length and (2) a bench plane having a second length, the kit comprising:

a handle attached to a frog, a blade attached to the frog, the blade having a front surface, a back surface, two sides, and a bevel intersecting (a) the front surface or another surface of the blade to from a cutting arris, and (b) the back surface, a first bench plane body having a mouth and a first length attachable to the frog, a second bench plane body having a mouth and a second length different from the first length attachable to the frog, and wherein the frog has a frog foot that projects into the mouth of the first plane body or the mouth of the second plane body when the frog is attached to a respective one of the two plane bodies and having a sloping surface along which the blade slides during adjustment and that is in contact with the blade at least immediately adjacent to the intersection of the blade back surface and the bevel.

34. The kit of claim 33, wherein the bodies each have a sole and the frog, when attached to either body, has a foot extending through the body to position a bottom of the foot at least essentially co-planar with the sole.

35. An assembly for attachment to a bench plane body to provide a bench plane, comprising:

a blade having a back surface, a front surface, and a cutting arris defined, in part, by a bevel intersecting the back surface, a frog attached to the blade and having a planar structure for contact with the plane body and foot projecting below the planar structure and having a sloping surface and a bottom surface for contact with a workpiece, a handle attached to the frog, and a mechanism for adjusting projection of the blade from the frog and tilt of the blade cutting arris relative to the frog.

36. A bench plane frog, comprising a casting having a planar structure for contact with a plane body and a foot projecting below the planar structure and having a sloping surface and a bottom surface for contact with a workpiece.

37. A bench plane frog assembly, comprising:

a frog adapted to be secured to the bed of a metal plane body, a rear handle attached to the frog, a blade having a back face terminating at an arris-forming bevel at one end of the blade and a cutting arris formed by the bevel, a chip breaker, and a lever cap securing the blade and the chip breaker to the frog, the frog having a planar structure for contact with a plane body and a frog foot projecting below the planar structure and having a sloping surface along which the blade slides during adjustment and that is in contact with the blade below the plane of the frog planar structure and at least immediately adjacent to the intersection of the blade back face and the bevel.

* * * * *

UNITED STATES PATENT AND TRADEMARK OFFICE

CERTIFICATE OF CORRECTION

PATENT NO. : 6,615,497 B1
DATED : September 9, 2003
INVENTOR(S) : Saunders et al.

It is certified that error appears in the above-identified patent and that said Letters Patent is hereby corrected as shown below:

Title page,
Item [73], Assignee, should read -- Lee Valley Tools, Ltd., Ottawa Canada --.

Signed and Sealed this

Twenty-seventh Day of April, 2004

JON W. DUDAS
*Acting Director of the United States Patent and Trademark Office*